US006928756B1

(12) United States Patent
Haynes

(10) Patent No.: US 6,928,756 B1
(45) Date of Patent: Aug. 16, 2005

(54) JUMP ASSISTING SPRING HEEL SHOE

(76) Inventor: Richard Haynes, 720 Long Island Ave., Ft. Lauderdale, FL (US) 33312

( * ) Notice: Subject to any disclaimer, the term of this patent is extended or adjusted under 35 U.S.C. 154(b) by 1 day.

(21) Appl. No.: 10/378,314

(22) Filed: Mar. 3, 2003

(51) Int. Cl.[7] ..... A43B 13/28; A43B 21/30

(52) U.S. Cl. ..... 36/27; 36/38

(58) Field of Search ..... 36/38, 27

(56) References Cited

U.S. PATENT DOCUMENTS

| | | | | | |
|---|---|---|---|---|---|
| 733,167 | A * | 7/1903 | Denton | 36/38 |
| 1,088,328 | A * | 2/1914 | Cucinotta | 36/38 |
| 3,886,674 | A * | 6/1975 | Pavia | 36/38 |
| 4,756,095 | A * | 7/1988 | Lakic | 36/27 |
| 5,282,325 | A * | 2/1994 | Beyl | 36/27 |
| 5,435,079 | A * | 7/1995 | Gallegos | 36/38 |
| 5,743,028 | A * | 4/1998 | Lombardino | 36/27 |
| 6,055,747 | A * | 5/2000 | Lombardino | 36/27 |
| 6,457,261 | B1 * | 10/2002 | Crary | 36/27 |
| 6,601,042 | B1 * | 7/2003 | Lyden | 36/27 |
| 6,751,891 | B2 * | 6/2004 | Lombardino | 36/383 |

* cited by examiner

*Primary Examiner*—Anthony Stashick
(74) *Attorney, Agent, or Firm*—Frank L. Kubler

(57) ABSTRACT

A shoe includes a shoe top structure secured to a sole having a sole forward segment for making contact with a shoe support surface such as the floor of a basketball court, and a sole rearward segment which arches upwardly and then extends rearwardly from the sole forward segment to be spaced above the shoe support surface, and including a heel in the form of a heel panel mounted beneath the sole rearward segment, and including spring means biasing the heel panel downwardly a certain distance from the sole rearward segment to define a vertical gap between the sole rearward segment and the heel panel. As a result of this construction, a downward thrust of a wearer heel inside the shoe presses the heel panel firmly against the shoe support surface drives the heel panel upwardly toward the sole rearward segment against the biasing of the spring means, thereby storing energy in the spring means. As the wearer rises off the heel panel, the spring means causes the heel panel to exert a downward force on the support surface, the spring means thereby adding upward acceleration to the wearer body to cause the wearer to rise higher in his or her step or jump than he or she would without this shoe.

6 Claims, 4 Drawing Sheets

JUMP ASSISTING SPRING HEEL SHOE

BACKGROUND OF THE INVENTION

1. Field of the Invention

The present invention relates generally to the field of shoes for wearing while playing various sports. More specifically the present invention relates to a shoe including a conventional shoe top structure secured to a sole having a sole forward segment for making contact with a shoe support surface such as the floor of a basketball court and having a sole rearward segment which arches upwardly and then extends rearwardly from the sole forward segment to be spaced above the shoe support surface, and including a heel in the form of a heel panel mounted beneath the sole rearward segment, and including spring means biasing the heel panel downwardly a certain distance from the sole rearward segment to define a vertical gap between the sole rearward segment and the heel panel. As a result of this construction, a downward thrust of a wearer heel inside the shoe presses the heel panel firmly against the shoe support surface and drives the heel panel upwardly toward the sole rearward segment against the biasing of the spring means, thereby storing energy in the spring means. As the wearer rises off the heel panel, the spring means causes the heel panel to exert a downward force on the support surface, the spring means thereby adding upward acceleration to the wearer body to cause the wearer to rise higher in his or her step or jump than he or she would without this shoe.

2. Description of the Prior Art

There have long been athletic shoes having heels formed of deformable simulated rubber material or compressible foam material. One version is believed to include a heel panel spaced downwardly from the sole rearward segment and upright and compressible foam columns extending between the sole and heel panel. A problem with these prior heels has been that they are merely shock absorbers which dissipate energy as heat, and return negligible or none of this energy to the wearer to provide lift in an immediately subsequent step or jump.

It is thus an object of the present invention to provide a shoe having a heel panel which deflects upwardly as the shoe impacts a support surface and which stores a substantial portion of the energy of impact in spring means and which releases the stored energy as the wearer rises off the heel panel to propel the heel panel downwardly against the support surface to enhance his or her step or jump.

It is another object of the present invention to provide such a shoe which has a unique and appealing appearance with a distinctive vertical space or gap between the sole rearward segment and the heel panel.

It is still another object of the present invention to provide such a shoe which is highly durable and which may be worn without risk of injury.

It is finally an object of the present invention to provide such a shoe which is relatively inexpensive to manufacture.

SUMMARY OF THE INVENTION

The present invention accomplishes the above-stated objectives, as well as others, as may be determined by a fair reading and interpretation of the entire specification.

A shoe is provided including a heel having a heel panel; a shoe top structure for retaining a user foot; a sole connected to the shoe top structure and having a sole forward segment for making contact with a shoe support surface; and a sole rearward segment arching upwardly and extending rearwardly from the sole forward segment over the heel panel and being spaced above the heel panel; a heel mounting structure interconnecting the sole rearward segment and the heel panel; and a spring mechanism biasing the heel panel downwardly a certain distance from the sole rearward segment and thereby defining a vertical gap between the sole rearward segment and the heel panel; so that a downward force on the sole rearward segment presses the heel panel against a shoe support surface and drives the heel panel upwardly toward the sole rearward segment against biasing of the spring mechanism, closing the gap and thereby storing energy in the spring mechanism, and so that reduction of the downward force permits the biasing of the spring mechanism on the heel panel causes the heel panel to exert a downward force on a support surface, the spring mechanism thereby adding upward force as a shoe wearer rises off the support surface.

The spring mechanism preferably includes a coil spring. The coil spring preferably extends substantially horizontally and laterally, the spring having a first spring end protruding radially from the spring coil and bearing downwardly against the heel panel and having a second spring end protruding radially from the spring coil and bearing upwardly against the sole rearward segment, biasing the heel panel and the sole rearward segment the certain distance apart from each other; so that thrusting the heel panel against a support surface rotates the spring ends relative to the spring coil about the spring coil against the biasing of the coil spring, thereby storing energy. The heel panel and the sole preferably converge toward each other. The shoe preferably additionally includes several spring straps, and the spring coil preferably is secured to the heel panel and to the sole with the spring straps fastened to the heel panel and to the sole. The shoe preferably additionally includes a spring recess channel in the sole receiving a portion of the spring coil and a spring recess channel in the heel panel receiving a portion of the spring coil, the spring recess channels maintaining the orientation of the heel panel relative to the sole. The heel panel preferably includes a plate having a panel lower surface at least partly covered by a high friction support surface gripping material for enhanced traction on a support surface. The sole forward segment preferably is at least partially covered by a high friction gripping material for enhanced traction on a support surface.

The sole has a sole lower surface and the spring mechanism alternatively includes a leaf spring having a leaf spring forward end and a leaf spring rearward end and the leaf spring forward end is fastened to the sole lower surface at the sole forward segment with a spring fastening structure and the spring rearward end extends rearwardly and is spaced below the sole rearward segment to define the heel panel and the vertical gap between the sole rearward segment and the heel panel. The leaf spring has a spring lower surface and the spring lower surface once again preferably is at least partly covered by gripping material for shoe traction on a support surface.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
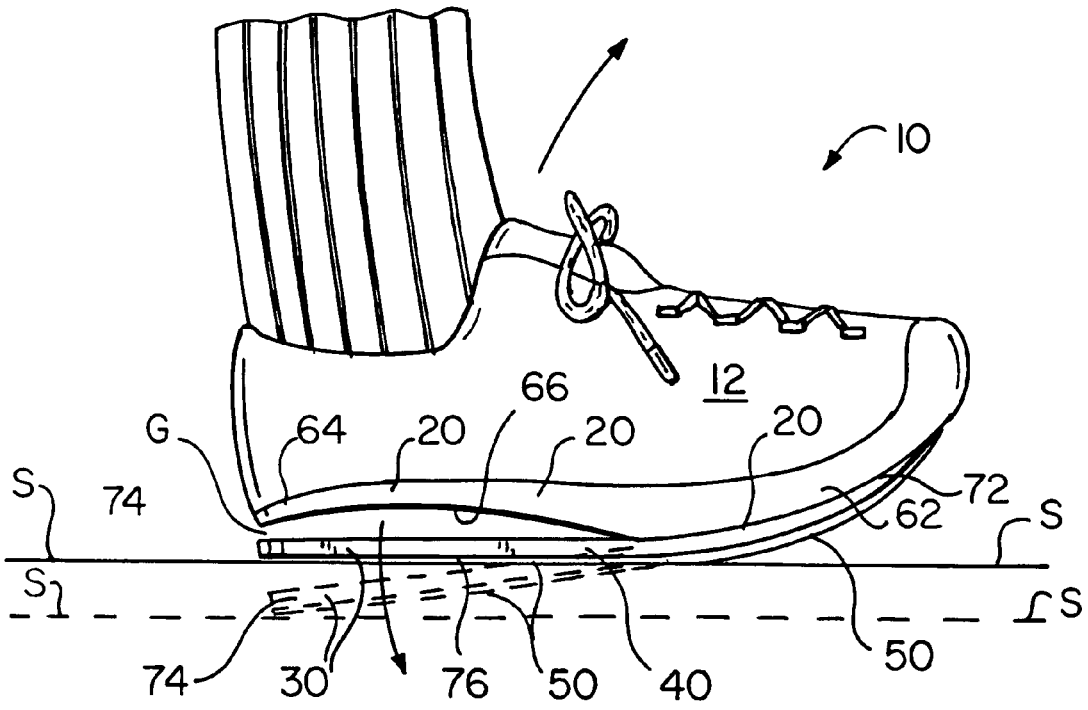
FIG. 1 is a side view of the second embodiment of the inventive shoe showing the spring biased heel panel deflected upwardly by impact with a support surface and simultaneously exerting a downward force on the support surface by releasing energy stored in the spring means, thereby enhancing the wearer step or jump.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Referring to FIGS. 1–7 generally, and to FIGS. 2–5 specifically, a shoe 10 is disclosed including a canvas or leather shoe top structure 12 of conventional design secured to a sole 20 having a sole forward segment 22 for making contact with a shoe support surface S such as the floor of a basketball court, a sole rearward segment 24 which arches upwardly and then extends rearwardly from the sole forward segment 22 to be spaced above the shoe support surface S and a sole lower surface 26, and including a heel in the form of a heel panel 30 mounted beneath the sole rearward segment 24, and including spring means 40 biasing the heel panel 30 downwardly a certain distance from the sole rearward segment 24 to define a vertical gap G between the sole rearward segment 24 and the heel panel 30. The biasing of the spring means 40 preferably is of sufficient magnitude that the weight of a person wearing a pair of shoes 10 either does not compress the spring means 40 at all, or compresses the spring means 40 only negligibly. The biasing of the spring means 40 preferably is of such a magnitude, however, that downward forces against the pair of shoes 10 as a person wearing the shoes runs or begins to jump or falls into contact with the ground at the conclusion of a jump is sufficient to overcome at least some of the biasing of the spring means 40 and thus to compress the spring means 40 at least partially. As a result of this construction, a downward thrust of a wearer heel inside the shoe 10 presses the heel panel 30 firmly against the shoe support surface S and drives the heel panel 30 upwardly toward the sole rearward segment 24 against the biasing of the spring means 40, closing gap G and thereby storing energy in the spring means 40. As the wearer rises off the heel panel 30, the spring means 40 causes the heel panel 30 to exert a downward force on the support surface S, the spring means 40 thereby adding upward acceleration to the wearer body to cause the wearer to rise higher in his or her step or jump than he or she would without the shoes 10.

Figure 2:
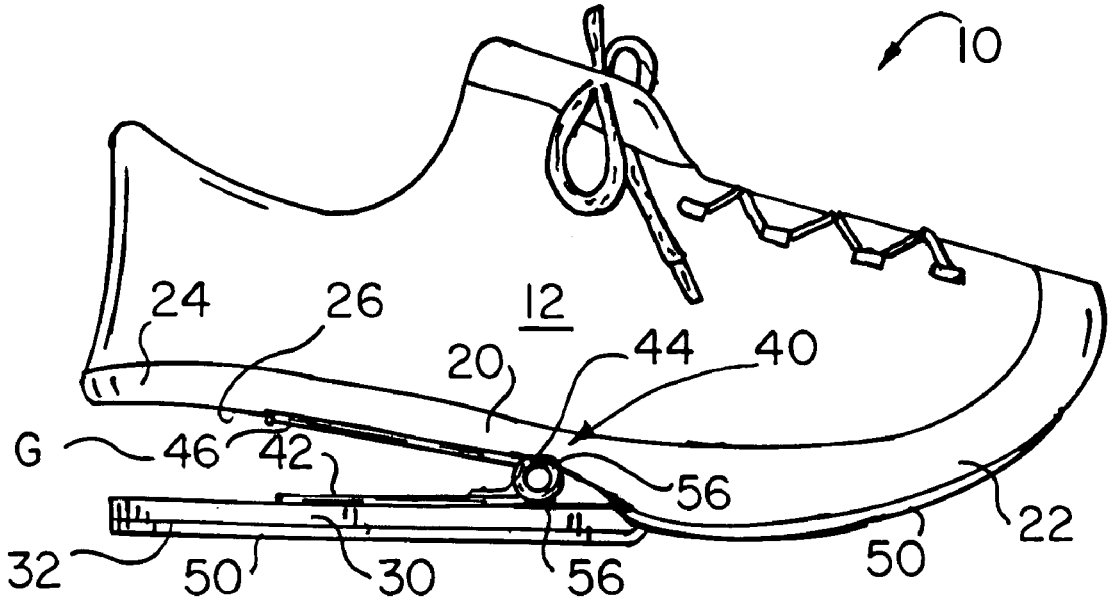
FIG. 2 is a side view of the shoe of the first embodiment, having the coil spring bearing against the heel plate.
Figure 5:
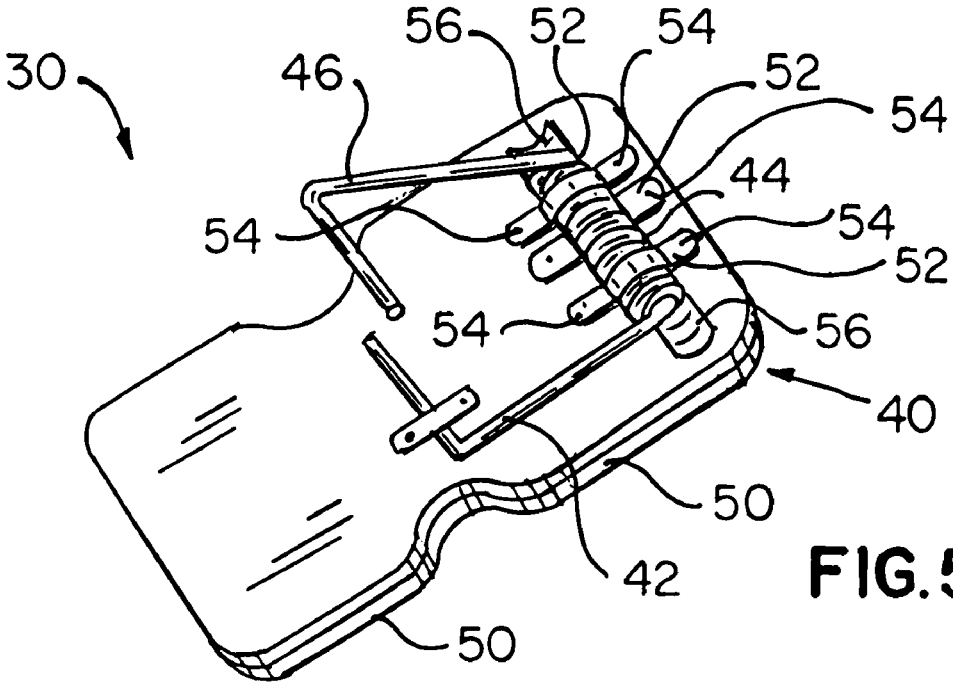
FIG. 5 is a perspective top view of the heel plate of the first embodiment, coil spring and spring mounting straps securing the spring coil to the heel plate and to the sole.
Figure 4:
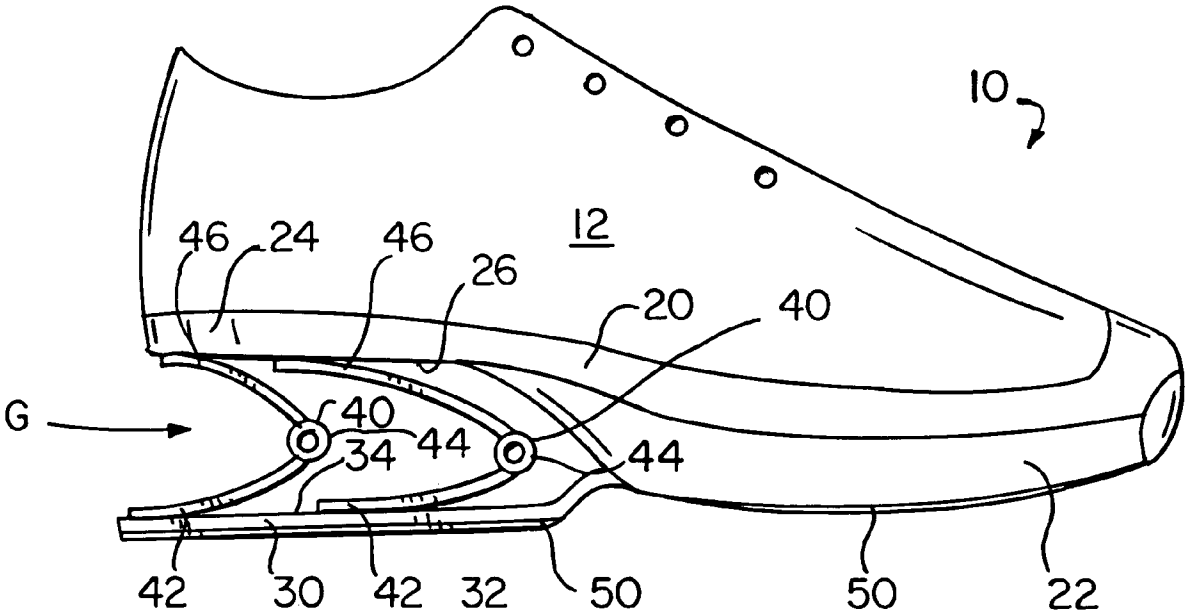
FIG. 4 is a side view of a shoe generally as in FIG. 2, but having two coil springs bearing against the heel plate. It is understood that the inventive shoe can include as many coil springs between the sole and heel plate as may be desired.
Figure 3:
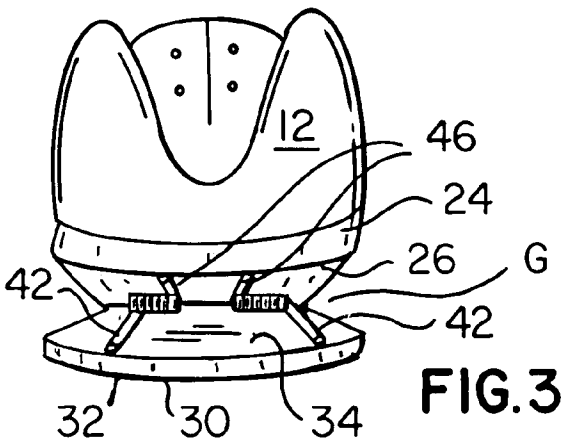
FIG. 3 is a rear view of the shoe of FIG. 2.
Figure 6:
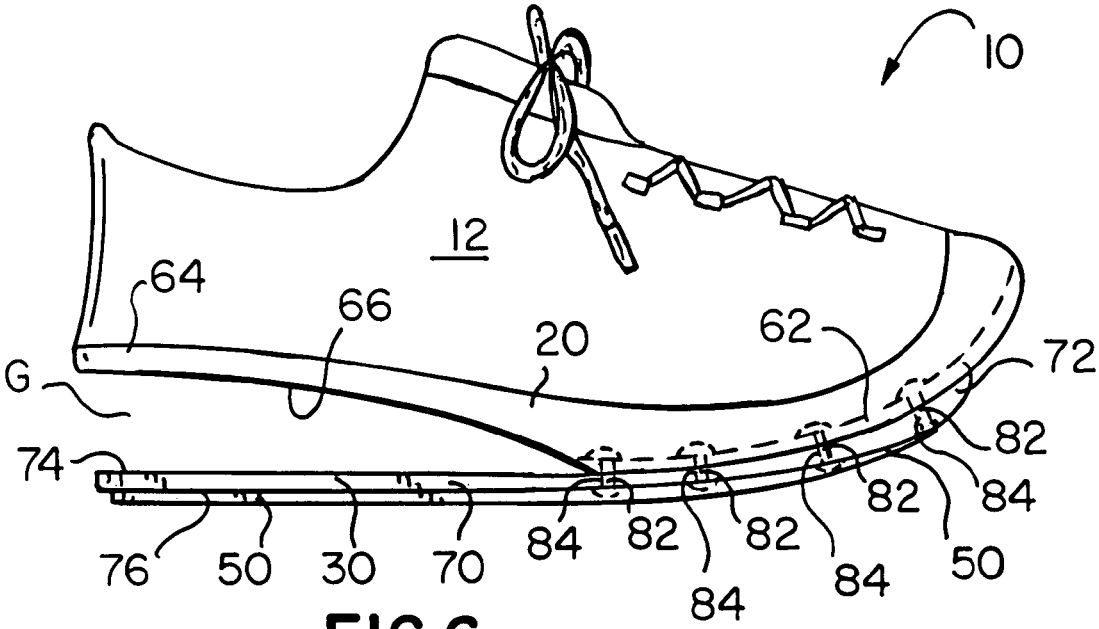
FIG. 6 is a side view of the shoe of the second embodiment, having the leaf spring and integral heel panel.
Figure 7:
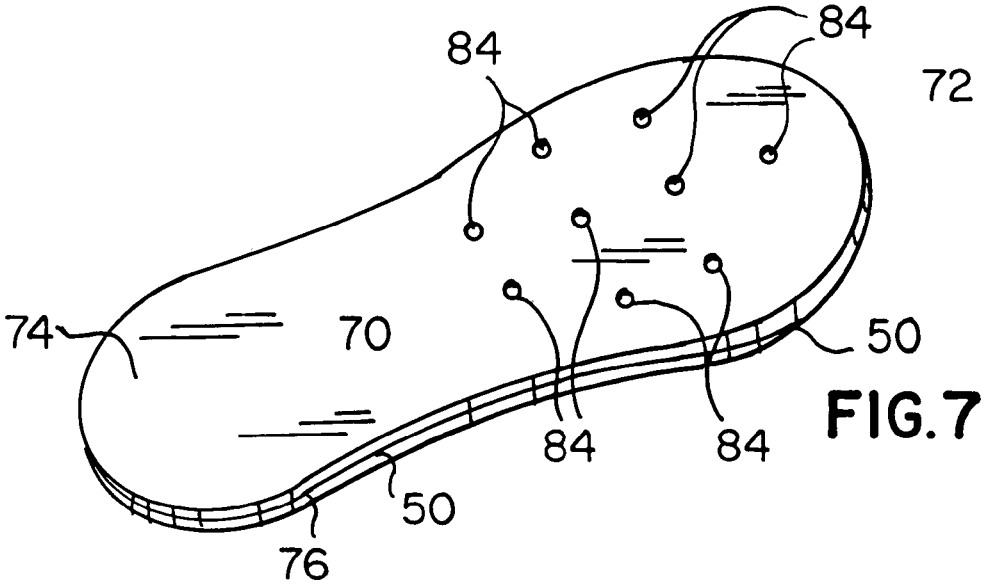
FIG. 7 is a perspective top view of the leaf spring of the second embodiment, showing the leaf spring fastener passing ports and showing an optional aesthetic leaf spring contour.

The heel panel 30 preferably is a metal plate having a panel lower surface 32 covered by high friction support surface gripping material 50, such as rubber, simulated rubber, or leather, this gripping material 50 also covering the sole lower surface 26 at the sole forward segment 22. The spring means preferably is a coil spring 40 extending horizontally and laterally adjacent to where the heel panel 30 and the sole 20 converge, the spring 40 having a first spring end 42 protruding radially from the spring coil 44 which bears downwardly against the heel panel 30 upper surface 34 and having a second spring end 46 protruding radially from the spring coil 44 which bears upwardly against the sole 20 lower surface 26 at the sole rearward segment 24, biasing the heel panel 30 and sole rearward segment 24 a certain distance apart from each other. The spring coil 44 is secured to the heel panel 30 and to the sole 20 with spring straps 52 secured with strap fasteners 54. To maintain the orientation of the heel panel 30 relative to the sole 20, the spring coil 44 preferably is mounted in recess channels 56 in heel panel 30 and sole 20. When the heel panel 30 is thrust against a support surface S, the spring ends 42 and 46 are rotated relative to the spring coil 44 about the axis of the spring coil 44 against the biasing of the spring 40, thereby storing energy. It is also contemplated that one or more coil springs 40 may be provided between the sole 20 and heel panel 30 and that these coil springs 40 may be oriented as shown in FIGS. 2–4.

Second Preferred Embodiment

For a second embodiment the sole 20 is a substantially rigid plastic or steel structure, once again having a sole forward segment 62 and a sole rearward segment 64 and a sole lower surface 66. See FIGS. 1, 6 and 7. The spring means 40 is a leaf spring 70 having a leaf spring forward end 72 and a leaf spring rearward end 74. The leaf spring forward end 72 is fastened to the sole lower surface 66 at the sole forward segment 62, with spring fasteners 82 passing through spring fastener ports 84, and the spring rearward end 74 extends rearwardly and is spaced below the sole rearward segment 64 to define the heel panel 30 and the vertical gap G between the sole rearward segment 64 and heel panel 30. The leaf spring 70 has a spring lower surface 76 which is covered by gripping material 50 described for the first embodiment. When the heel panel 30 is thrust against a support surface S spring rearward end 74 deflects against the biasing of spring 70 toward the sole rearward segment 64, storing energy for an immediately subsequent step or jump.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

What is claimed is:

1. A shoe comprising:

a heel comprising a heel panel;

a shoe top structure for retaining a user foot;

a sole connected to said shoe top structure and having a sole forward segment for making contact with a shoe support surface;

and a sole rearward segment arching upwardly and extending rearwardly from said sole forward segment over said heel panel and being spaced above said heel panel;

heel mounting means interconnecting said sole rearward segment and said heel panel;

and spring means comprising a coil spring and biasing said heel panel downwardly a certain distance from said sole rearward segment and thereby defining a vertical gap between said sole rearward segment and said heel panel, said coil spring having a spring coil with a spring coil longitudinal axis extending across the width of and substantially parallel to said heel panel, said spring having a first spring end protruding radially from said spring coil and bearing downwardly against said heel panel and having a second spring end protruding radially from said spring coil and bearing upwardly against said sole rearward segment, biasing said heel panel and said sole rearward segment said certain distance apart from each other;

such that a downward force on said sole rearward segment presses said heel panel against a shoe support surface and drives said heel panel upwardly toward said sole rearward segment against biasing of said spring means, closing the gap and thereby storing energy in said spring means, and such that reduction of the downward force permits the biasing of said spring means on said heel panel causes said heel panel to exert a downward force on a support surface, said spring means thereby adding upward force as a shoe wearer rises off the support surface;

such that thrusting said heel panel against a support surface rotates said spring ends relative to said spring coil about said spring coil against the biasing of said coil spring, thereby storing energy.

2. The shoe of claim 1, wherein said heel panel and said sole converge toward each other.

3. The shoe of claim 1, additionally comprising a plurality of spring straps, wherein said spring coil is secured to said heel panel and to said sole with said spring straps fastened to said heel panel and to said sole.

4. The shoe of claim 1, additionally comprising a spring recess channel in said sole receiving a portion of said spring coil and a spring recess channel in said heel panel receiving a portion of said spring coil, said spring recess channels maintaining the orientation of said heel panel relative to said sole.

5. The shoe of claim 1, wherein said heel panel comprises a plate having a panel lower surface at least partly covered by a high friction support surface gripping material for enhanced traction on a support surface.

6. The shoe of claim 1, wherein said sole forward segment is at least partially covered by a high friction gripping material for enhanced traction on a support surface.

* * * * *